United States Patent [19]

Whitson et al.

[11] 4,004,842

[45] Jan. 25, 1977

[54] METHOD OF PROVIDING A SILICON DIODE ARRAY TARGET WITH IMPROVED BEAM ACCEPTANCE AND LAG CHARACTERISTIC

[75] Inventors: Walter J. Whitson; Alfred B. Laponsky, both of Horseheads; Raymond J. Malanoski, Waverly, all of N.Y.

[73] Assignee: Westinghouse Electric Corporation, Pittsburgh, Pa.

[22] Filed: Sept. 5, 1975

[21] Appl. No.: 610,710

[52] U.S. Cl. ..... 316/1

[51] Int. Cl.[2] ..... H01J 9/233

[58] Field of Search ..... 313/94; 316/1, 27

[56] References Cited

UNITED STATES PATENTS 3,630,590 12/1971 Dermstedt et al. ..... 316/1 X

*Primary Examiner*—Richard B. Lazarus

*Attorney, Agent, or Firm*—W. G. Sutcliff

[57] ABSTRACT

A charge storage diode array target is provided with a resistive layer over the output side of the target over the diode portions and the area between diodes, with metal contact caps over the resistive layer over the diode portions. The target is operationally aged with input radiation sufficient to produce an output signal current density of at least about 300 nanoamps per square centimeter at a given reverse bias potential, for a period of at least 50 hours. The target thereafter exhibits high beam acceptance and low lag characteristic.

1 Claim, 3 Drawing Figures

METHOD OF PROVIDING A SILICON DIODE ARRAY TARGET WITH IMPROVED BEAM ACCEPTANCE AND LAG CHARACTERISTIC

BACKGROUND OF THE INVENTION

The present invention relates to diode array target as used in electron tubes of the pick-up type. A particular diode target type of the mesa or pillar type is described in U.S. Pat. No. 3,821,092, and in copending application Ser. No. 462,918, filed Apr. 22, 1974, entitled "Deep Etch Metal Cap Silicon Diode Target" also owned by the assignee of the present invention. The diode target described in the above are mesa or pillar-type diode targets, with massive high surface area contact caps extending from the pillar diode on the read or output side of the target.

An oxide insulating layer is typically provided on the output surface of diode targets between the individual diodes to ensure that the scanning electrons land only on the contact caps and thus maintain the reverse bias potential across the diodes which is required to generate the output signal as a function of the input radiation.

The protruding metal contact caps extending from the diodes serve as electron beam acceptance pads and as protection against target deterioration. The target will have a dark current level increase with operating time as a result of soft X-ray damage to the semiconductive target. The size of the metal caps protects the area between the diodes to prevent electrons landing on the oxide layer and building up there as a distorting charge pattern. It was found that such distorting oxide charging could be eliminated by disposing a high resistivity surface leakage path on the oxide. However, the resistive layer imparted a poor lag characteristic to the target. The lag is the response time of the target to charging input radiation patterns and is largely a function of the capacitance of the target. The resistive layer diode target when initially operated does exhibit a degraded beam acceptance and longer lag characteristic.

SUMMARY OF THE INVENTION

It has been discovered that for such resistive layer diode targets the beam acceptance and lag characteristic can be improved by operationally aging the target. Input radiation is directed onto the target sufficient to produce an output signal current density of at least about 300 nanoamps per square centimeter. The reverse bias potential across the diodes is maintained at about 7.5 volts, and the output signal generated for at least about 50 hours.

In this way beam acceptance of between 60–70 percent has been attained, the lag characteristic significantly reduced, and charging of the target between the diodes eliminated.

DESCRIPTION OF THE PREFERRED EMBODIMENTS

Figure 1:
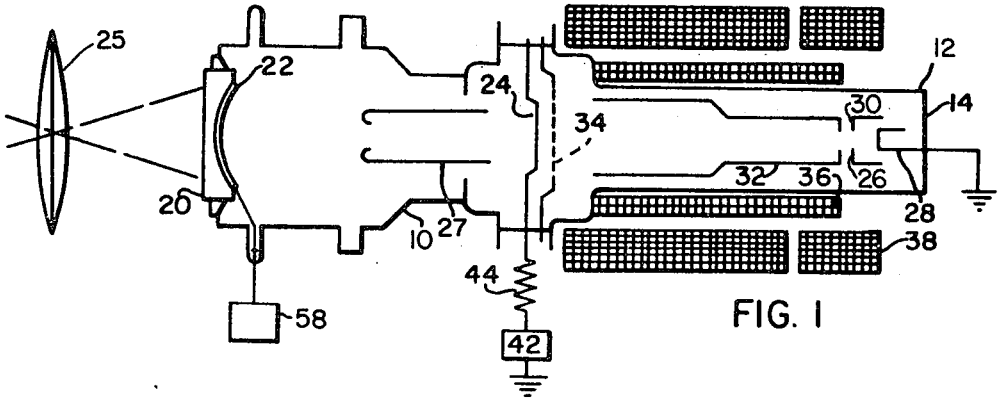
FIG. 1 is a schematic illustration of a pick-up electron tube incorporating a target in accordance with the teachings of this invention.

In FIG. 1, there is illustrated a pick-up tube comprising an evacuated envelope 10 including a tubular body portion 12 having a button stem 14, provided at one end thereof for closing off that end of the tubular portion 12. The button stem 14 also includes a plurality of lead-ins (not shown) for applying potentials to the electrodes within the envelope 10. The other end of the tubular body member 12 is closed off by a faceplate 20. The faceplate 20 is of a suitable material transmissive to the input radiation from the scene to be viewed. A suitable material for the face-plate 20 is glass or quartz. The faceplate 20 may be of a fiber optic type construcion. A photocathode 22 is provided on the inner surface of the faceplate 20. The photocathode 22 may be of a suitable material responsive to the input radiation such as a multi-alkali photocathode material. The photocathode 22 will absorb the input radiations directed and focused thereon by a suitable lens 25. A target 24 is provided between the photocathode 22 and the reading electron gun 26. Photoelectrons emitted by the photocathode 22 are focused by suitable means such as an electrode 27 onto the target 24. Suitable structure for imaging the photoelectrons onto the target are well known and are described in volumes 1 and 2 of Photoelectronic Imaging Devices, Plenum and Press, New York-London, 1971.

The reading electron gun 26 is provided at the opposite end of the envelope 10 with respect to the target 24 and generates a pencil-like electron beam for scanning a raster over the target 24. The electron gun 26 is comprised of a cathode 28 which may be at ground potential. A control grid 30 and a focusing electrode 32 may also be provided in the electron gun 26. A grid 34 may be provided adjacent to target 24 and may be at a potential of about 500 volts positive with respect to ground. The electron gun 26 may be focused by either electrostatic or electromagnetic means. An electromagnetic focusing coil 36 is provided about the outer portion of the tubular member 12. The deflection means may also be electrostatic or electromagnetic, and in this specific device is shown as electromagnetic coil 38 for deflection of the electron beam to scan a raster over the target 24. The photocathode 22 may be connected to a high potential source 58 of about 10,000 volts negative with respect to ground. The target member 24 is provided with a suitable potential of about 10 volts positive with respect to ground by means of a potential source 42. A resistor 44 is also provided between the voltage source 42 and the target 24 for deriving the output signal from the device.

Figure 2:
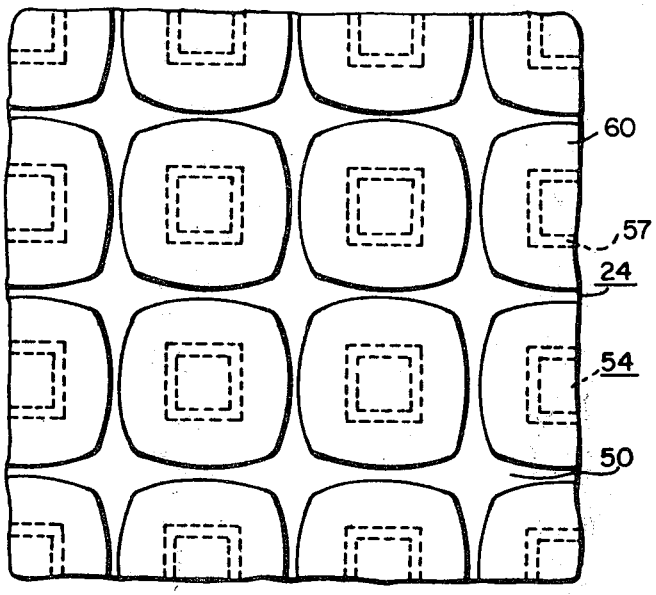
FIG. 2 is a plan view of a fragment of the scan or output side of the target.
Figure 3:
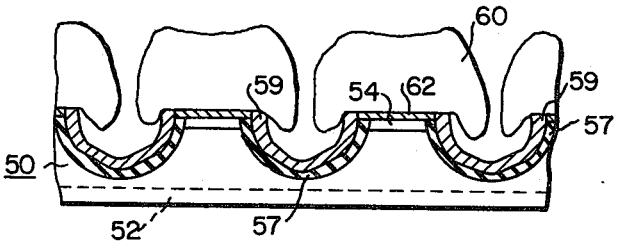
FIG. 3 is a sectional view taken through the target.

The target 24 is a diode target array and is shown in more detail in FIGS. 2 and 3. The target 24 is comprised of a body or substrate 50 which may be of a suitable semiconductive material such as silicon, germanium, or indium arsenide. In the specific device illustrated in FIGS. 2 and 3, the substrate 50 is of a n-type silicon material having a resistivity of about 10 ohm centimeters. The crystal orientation of a wafer may be of any suitable type such as [111], or [100], or [110]. The input side of the target 24, that is, the side facing the photocathode 22 is provided with an N+ layer 52. The N+ layer 52 serves not only as the electrical contact of the target 24, but also establishes a field to prevent holes from recombining at the input surface.

The opposite side of the body 50 remote to the photocathode 22 is referred to as the read or output side of the target 24. The output side of the target 24 shown in FIG. 2 is provided with a pluarlity of pillars 54 extending from the substrate 50. The pillars 54 extend for a distance of about 3 to 5 microns above the upper surface of the body 50. The pillar 54 has a rectangular cross-section and is about 4 microns on a side. The pillars 54 are formed from the wafer by etching out the surrounding portions of the wafer to provide a moat portion 55 about the pillars 54. The distance from the bottom surface 56 of the moat 55 and the opposite or the input surface of the wafer is about 10 microns. The recessed surface 56 as well as the side walls of the pillars 54 are provided with a coating 57 of a suitable insulating material such as silicon dioxide. The thickness of the coating 57 may be about 0.5 to about 1 micron. A conductive contact or pad 60 is provided on the top of each of the pillars 54 and the conductive contacts 60 cover not only the top surface of the pillar 54 but extend out over the insulating coating 57 provided on the side walls of the pillar 54 and the recess surface 56 so as to provide a gap of about 2 microns between the adjacent conductive contacts 60. The conductive contacts 60 may be of a suitable electrical conductive material such as gold.

As best seen in FIG. 3, a high resistivity layer 59 is disposed over the entire output side of the diode target prior to deposition of the metal contact caps. The resistive layer 59 may typically be silicon nitride or silicon carbide, with a sheet resistivity of about $5 \times 10^{15}$ ohms per unit area to $10^{16}$ ohms per unit area. The resistive layer 59 is deposited to a thickness of from about 100–1000 Angstroms. The function of the resistive layer is to drain any electrons which land on the surface between the contact caps. The high surface area, metal contact caps 60 are provided over the resistive layer 59 over the diode portions of the target.

In the operation of the device of FIG. 1, radiation from a scene is directed through the lens 25 onto the photocathode 22. This radiation is absorbed by the photoemissive cathode 22 and the photoelectrons are generated and accelerated into the target 24. The electron beam from the electron gun 26 initially established and periodically reestablishes a reverse bias on the PN junction formed within the target 24 between the contact 60 and the wafer 50. The electrons enter through the layer 52 into the n-type body or substrate region 50 and produce corresponding patterns of electron hole pairs in response to electron bombardment. The holes diffuse to the junction of the diodes formed and partially discharge the reverse biased diodes. The electron beam from the electron gun 26 will recharge said diodes on the next scan and will produce an output pulse to the video output which is taken across the resistor 44. The operation is such that the electron gun 26 charges the contact 60 to cathode potential while the backplate formed by the layer 52 is at a positive potential of about 7.5 volts.

A series of diode array targets and tubes incorporating the targets was tested. This first series of tubes included the resistive layer 59 and the lag characteristic for the tubes was determined. The lag is measured here by operating the tube with a portion of the target impinged by input radiation and an output signal current measured for the input radiation. The input radiation is turned off and after 50 milliseconds an output signal current was measured. The lag is the ratio of this 50 millisecond signal to the earlier output signal. The lag characteristic was initially found to 19 percent.

A second series of tubes also including the resistive layer 59, were operationally aged by directing input radiation sufficient to produce an output signal current density of at least 300 nanoamps per square centimeter. The reverse bias potential was maintained at about 7.5 volts. The aging was carried out for at least 50 hours. The lag characteristic for such tubes was found to be 13 percent.

In each series there was no observed charge build up on the resistive layer, and the beam acceptance for the tube was very high.

The resistive layer and aging of the target can also be expected to improve planar diode targets as well as the mesa or pillar types, and to also be useful with other contact pad structures.

We claim:

1. A method of producing an electron tube of the pick-up type having a photoemissive input portion, a generally planar diode array target portion, with photoelectrons from the photoemissive input portion being collected on the input side of the diode array target, and electronic scanning means spaced from the output side of the target for maintaining a reverse bias potential across the individual diodes of the array, and where the diode array target portion includes enlarged high surface area metal contact caps extending from individual diode portions on the output side of target, and wherein a thin layer of high resistivity material is disposed over the output side surface of the target covering the diode portions and the surface between diode portions, the method for providing a high electron beam acceptance and improved lag characteristic by operationally aging the target with input radiation sufficient to produce an output signal current density of at least about 300 nanoamps per square centimeter, with the reverse bias potential maintained at about 7.5 volts, for at least 50 hours.

* * * * *